United States Patent [19]

Kasuya et al.

[11] Patent Number: 4,530,593

[45] Date of Patent: Jul. 23, 1985

[54] IMAGE FORMING APPARATUS WITH ATTACHMENT

[75] Inventors: Yukio Kasuya, Tokyo; Toshiaki Yagasaki, Hino; Shunichi Masuda, Tokyo, all of Japan

[73] Assignee: Canon Kabushiki Kaisha, Toyko, Japan

[21] Appl. No.: 597,563

[22] Filed: Apr. 6, 1984

Related U.S. Application Data

[63] Continuation of Ser. No. 367,724, Apr. 12, 1982, abandoned.

[30] Foreign Application Priority Data

| | | | |
|---|---|---|---|
| Apr. 17, 1981 | [JP] | Japan | 56-57218 |
| May 13, 1981 | [JP] | Japan | 56-70626 |
| May 13, 1981 | [JP] | Japan | 56-70627 |

[51] Int. Cl.[3] ..... G03G 15/00

[52] U.S. Cl. ..... 355/14 R; 355/14 SH; 271/288

[58] Field of Search ..... 355/14 R, 14 SH, 3 SH; 271/287, 288, 290

[56] References Cited

U.S. PATENT DOCUMENTS

| | | | |
|---|---|---|---|
| 4,295,733 | 10/1981 | Janssen et al. | 355/14 SH |
| 4,365,887 | 12/1982 | Kakitani et al. | 355/14 R |
| 4,370,052 | 1/1983 | Murakami et al. | 271/288 X |

*Primary Examiner*—R. L. Moses

*Attorney, Agent, or Firm*—Fitzpatrick, Cella, Harper & Scinto

[57] ABSTRACT

An image forming apparatus and attachment capable of displaying an indication that the device has been instructed to process a number of images that exceeds the processing capacity of the attachment. The displayed indication is in the form of a numeral indicating the processing capacity of the attachment.

12 Claims, 7 Drawing Figures

IMAGE FORMING APPARATUS WITH ATTACHMENT

This application is a continuation of application Ser. No. 367,724 filed Apr. 12, 1982, now abandoned.

BACKGROUND OF THE INVENTION

1. Field of the Invention

The present invention relates to an image forming apparatus with an attachment such as a sorter, and more particularly to such an image forming apparatus with attachment capable of displaying that the desired number of image processings exceeds the processing capacity of said attachment to be used in combination with said image forming apparatus.

2. Description of the Prior Art

The use of an attachment such as a sorter in combination with an image forming apparatus for improving the work efficiency of the apparatus such as a copier or a printer is already known. However, when processing a number of copies exceeding the processing capacity of said attachment is instructed, the copies exceeding said processing capacity are processed as if said attachment does not exist, so that the attachment does not contribute to the improvement of work efficiency in such case.

For example, in a usual combination of a copier and a sorter, the copier is capable of producing copies up to the maximum set number, while the sorter sequentially sorts the entered copies and puts all the copies exceeding the sorting capacity into a particular non-sort bin. If 40 copies are introduced into a sorter having 20 sorting bins, the first 20 copies are thus sorted but the remaining 20 copies exceeding the sorting capacity are put into the non-sort bin. In case of sorting 40 sets of copies each consisting of 30 pages with such sorter, the first 20 sets can be sorted by distributing copies into 20 bins 30 times, but the copies put into said non-sort bin amount to $20\times30=600$ copies, which have to be manually sorted with a significant cost in time and labor.

SUMMARY OF THE INVENTION

The object of the present invention is to provide an image forming apparatus with attachment, which is not associated with the foregoing drawback and is capable of displaying, by a display device for indicating numbers relating to image formation cycles, that a number exceeding the processing capacity of said attachment is instructed.

Another object of the present invention is to provide an image forming apparatus with attachment capable of displaying the state of said attachment under certain conditions by a display device for indicating numbers relating to image formation cycles.

The foregoing and still other objects of the present invention will be made fully apparent from the following description.

DESCRIPTION OF THE PREFERRED EMBODIMENTS

Now the present invention will be clarified in detail by the following description to be taken in conjunction with the attached drawings.

Figure 1:
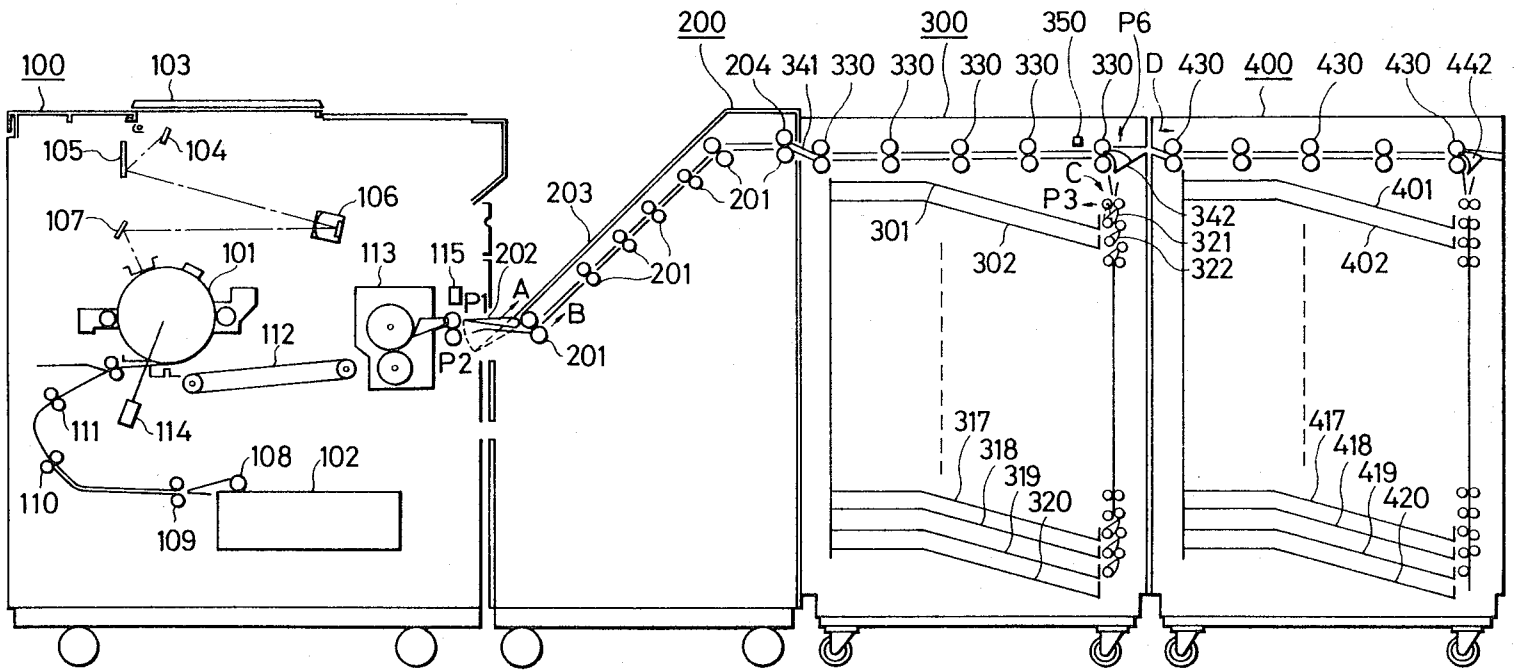
FIG. 1 is a schematic view showing the combined structure of a copier and a sorter.

FIG. 1 shows a combination of a copier 100 with first and second sorters 300, 400 through a bridge 200. The copier 100 is provided with a photosensitive drum 101 and a sheet cassette 102. The image of an original placed on a platen 103 is recorded on said drum 101 through mirrors 104, 105, an in-mirror lens 106 and another mirror 107. The electrostatic latent image thus formed on the drum 101 is developed as a visible image, which is transferred onto a copy sheet fed from said cassette 102 by a feed roller 108 and advanced to the photosensitive drum 101 through transport rollers 109, 110 and 111. Said copy sheet is then transferred through a conveyor 112 to a fixing station 113, where the transferred image is fixed. A drum clock pulse generator 114 generates drum clock pulses in synchronization with the rotation of the drum 101 in order to effect various sequence controls, and a sensor 115 is provided to detect the copy sheet ejected from the copier to the outside. The copy sheet with fixed image is thus received by the bridge 200 and is transported to the first sorter 300 by transport rollers 201 rotated by an unrepresented motor. Between the bridge 200 and the exit of the copier there is provided a path switching finger 202, which directs the copy sheets either to a direction B at the full-lined position P1 or to a direction A leading to a non-sort bin 203 at the broken-lined position P2. The copy sheets transported into the sorter 300 are further advanced by rollers 330 rotated by an unrepresented motor. The sorted copy sheets are sequentially placed in twenty trays 301–320 constituting 1st to 20th bins from top to bottom.

When the path switching finger 202 is positioned at P1 to direct the copy sheets to the direction B, the copy sheets transported in the bridge 200 reach an exit 204 at the rear end of said bridge 200, and enter the first sorter 300 through an entrance 341 thereof. Said first sorter 300 is provided with an exit selector finger 342, which is positioned as illustrated to direct the copy sheets in a direction C in case of sheet sorting in the first sorter 300. Along said direction C provided is a bin selector finger 321, which is placed at the full-lined position in case of sorting a copy sheet into the first bin 301. After a copy sheet is stored in said first bin 301, the bin selector finger 321 is retracted in a direction P3 to a broken-lined position, whereby a succeeding copy sheet passes said bin selector finger 321 and is stored in the 2nd bin 302 by another bin selector finger 322.

After a copy sheet is stored in the final 20th tray 320 in the similar manner, no sorting capacity is left in the first sorter 300 for the succeeding copies. A sheet sensor 350 provided in the sheet transport path of the first sorter 300 counts the number of transported copies and deflects the exit selector finger 342 to a direction P6 upon counting 20 sheets, whereby the 21st sheet is directed to a direction D leading to the second sorter 400.

The second sorter 400 sorts the 21st to 40th sheets in the similar manner as in the first sorter 300. An exit selector finger 442 provided in the second sorter 400 is used only in an emergency. In case the number of copy sheets exceeds the sorting capacity of the first and second sorters 300, 400, the path switching finger 202 is changed over to a position P2 whereby the excessive copy sheets are not ejected from said exit 442 but are ejected to the non-sort bin 203.

As already explained in the foregoing, the copy sheets exceeding the sorting capacity of the first and second sorters 300, 400 and thus ejected to said non-sort bin 203 have to be manually sorted anew, thus requiring additional time.

According to the present invention, the sorting capacity of the sorters connected to the copier is transmitted to the copier and is displayed on the set number display device thereof for a determined period upon actuation of a sorter selecting button, whereby the operator can know said sorting capacity prior to the start of copying operation.

Figure 2:
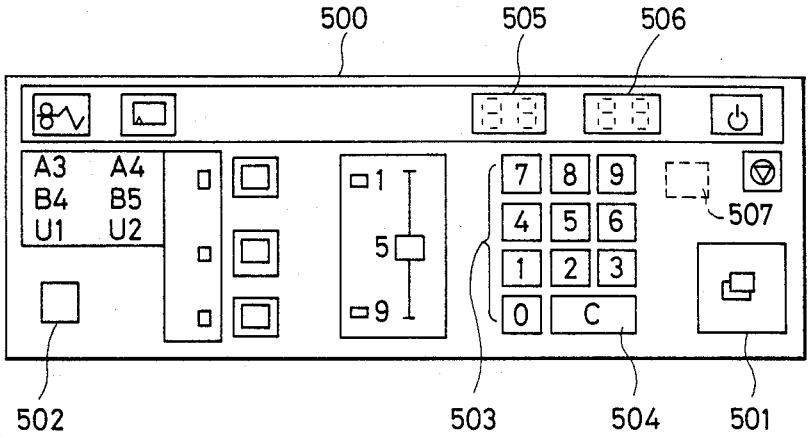
FIG. 2 is a plan view of a control panel of said copier.

FIG. 2 shows an example of the control panel 500 of said copier, wherein provided are: a copy start button 501 for starting the copying operation; a sorter selecting button 502 to be actuated for using the sorter; numeral keys 503 for setting the desired number of copies; a clear key 504 for I5 clearing the erroneous setting by said numeral keys; a set number indicator 505 for displaying the set number selected by said numeral keys 503; a copy number indicator 506; a set number overflow lamp 507 to be lighted in case the copy set number exceeds the processing capacity of the sorters.

Figure 4:
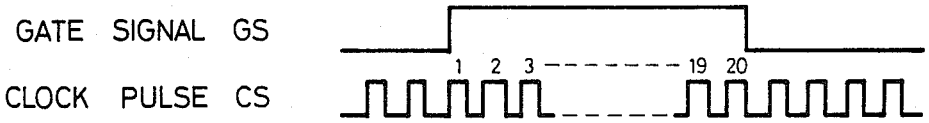
FIG. 4 is a waveform chart showing gate signals and clock pulses.
Figure 3:
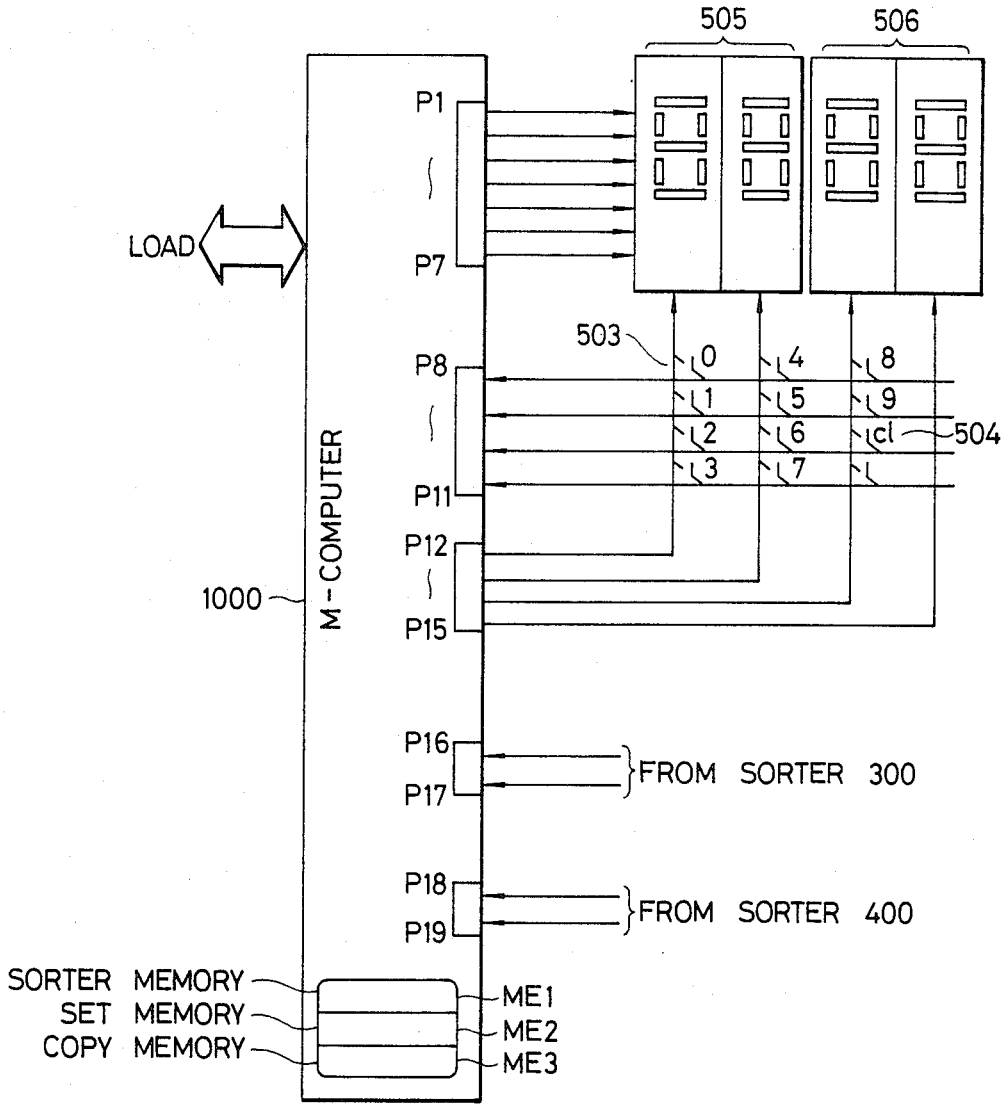
FIG. 3 is a block diagram showing a control unit of said copier.

FIG. 3 shows the structure of a control microcomputer 1000 provided in the copier 100, wherein output ports P1–P7 provide 7-segment signals for displaying first and second digits on the set number indicator 505 and on the copy number indicator 506. Input/output ports P8–P11 and P12–P15 receive and release control signals for example for displaying the set number entered by the numeral keys 503 or the copy number on the indicators 505, 506. There are also provided input ports P16, P18 for receiving gate signals and input ports P17, P19 for receiving clock pulses CS (cf. FIG. 4). Said ports P16, P18 receive gate signals (cf. FIG. 4) from the first and second sorters 300, 400 for a period corresponding to the sorting capacity thereof, i.e. the number of sorting bins therein, to open gates, whereby the number of pulses entered in the ports P17, P19 during said period is counted to transmit the sorting capacity to the copier. The microcomputer 1000 is provided with a sorter memory ME1 for storing the sum of the sorting capacities transmitted from the sorters 300, 400. Said microcomputer is further provided with a set number memory ME2 for storing the set number entered from the numeral keys 503 and a copy number memory ME3 for storing the number of completed copies.

The following is an explanation of the control procedure when a set number of desired copies is entered from the numeral keys 503.

At first a Step S1 identifies the presence or absence of key entry. Then the program proceeds to the Step S2 for storing the number entered by the keys into the set number memory ME2. The succeeding Step S3 identifies if the gate signal GS is already initiated. In the present embodiment the ports P16, P18 are opened at the initializing at the start of power supply, so that the program proceeds to the Step S4, in which the pulses transmitted from the first and second sorters 300, 400 are counted and added. In the succeeding Step S5 the result of said addition is stored in the sorter memory ME1. The succeeding Step S6 identifies if the sorter selecting button 502 is actuated. If so, the program proceeds to the Step S7 for displaying the number stored in the sorter memory ME1 on the set number indicator 505. After the lapse of a determined time in the Step S8, the Step S9 displays the number stored in the set number memory ME2 on the set number indicator 505.

In the foregoing embodiment the processing capacity of the attachment such as the sorter is displayed on the set number indicator 505 provided in the control panel 500 of the copier 100, but it is also possible to display said capacity on the copy number indicator, or on a separate indicator, or on an indicator to be provided on the sorter.

It is furthermore possible to display the remaining sorting capacity of the attachment for a given period in case the sorter selecting button is actuated again during the course of the copying operation, and, in this manner, the operator can easily confirm the remaining sorting capacity in the course of a copying operation or interrupt the copying operation exceeding the sorting capacity. It is furthermore possible to display the number of copies that can be stored in the sorter independently from the number of bins therein.

Figure 5:
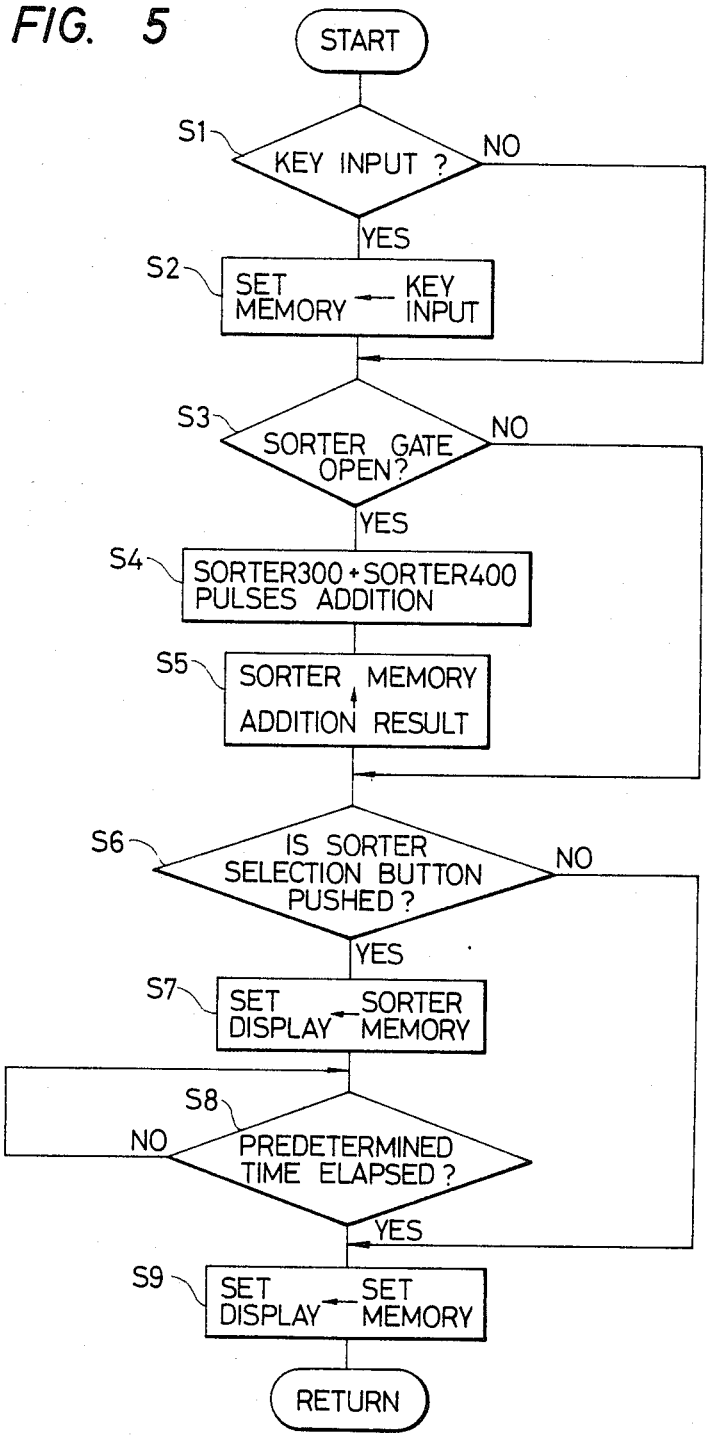
FIGS. 5 to 7 are control flow charts showing certain embodiments of the present invention.
Figure 6:
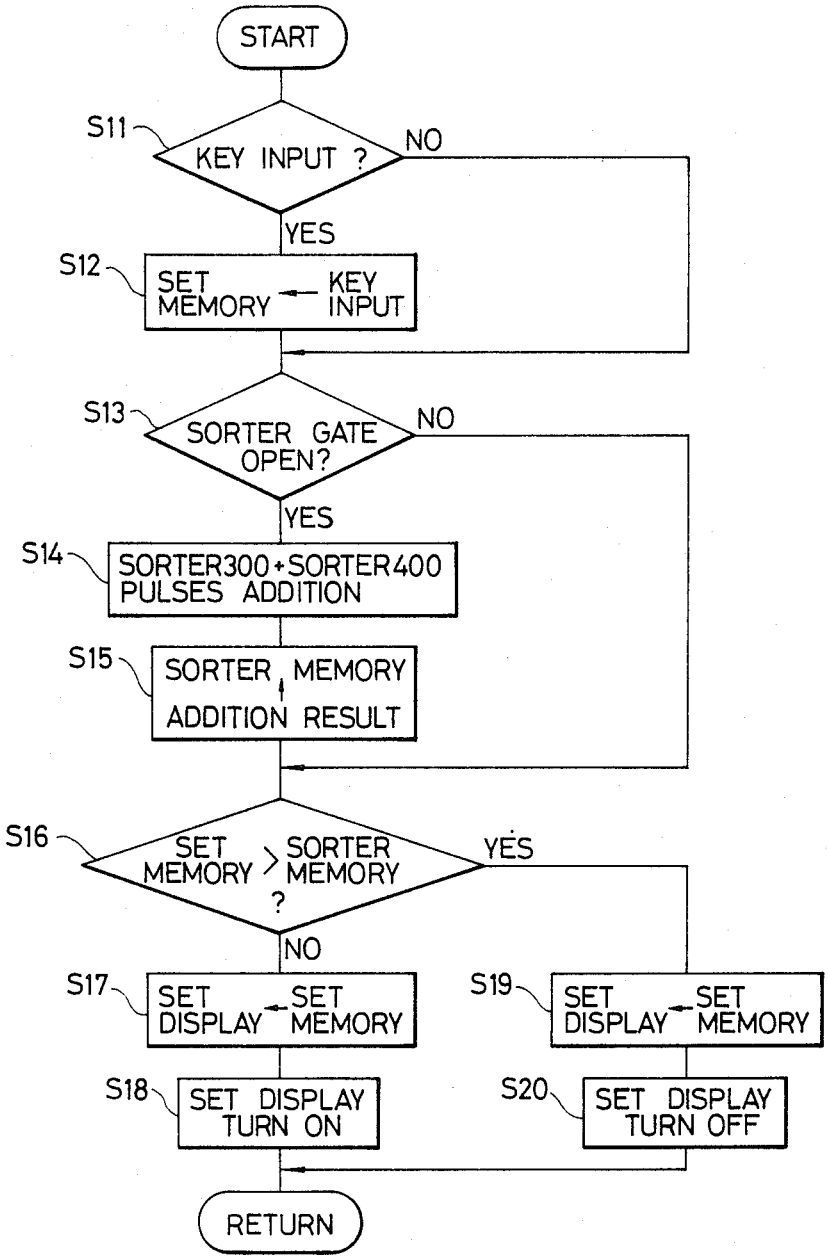

In another embodiment the sorting capacity of the sorter is transmitted to the copier connected thereto and the set number indicated on the set number indicator is changed to intermittent lighting in order to give a warning to the operator in case the number of copies to be produced exceeds said sorting capacity. Said embodiment will be further explained in relation to FIGS. 2 and 6, in which the Steps S11 to S15 are identical with the Steps S1 to S5 shown in FIG. 5 and are therefore omitted from the following explanation.

The Step S16 compares the content of the set number memory ME2 with that of the sorter memory ME1. If the former is smaller, the program proceeds to the Step S17 for displaying the number stored in the set number memory ME2 on the set number indicator 503, and then to the Step S18 for continuously displaying said set number on the set number indicator 503.

On the other hand, if the former is larger in the Step S16, the program proceeds to the Step S19 for supplying the number stored in the set number memory ME2 to the set number indicator 503 and then to the Step S20 for intermittently displaying said set number on the set number indicator 503.

Figure 7:
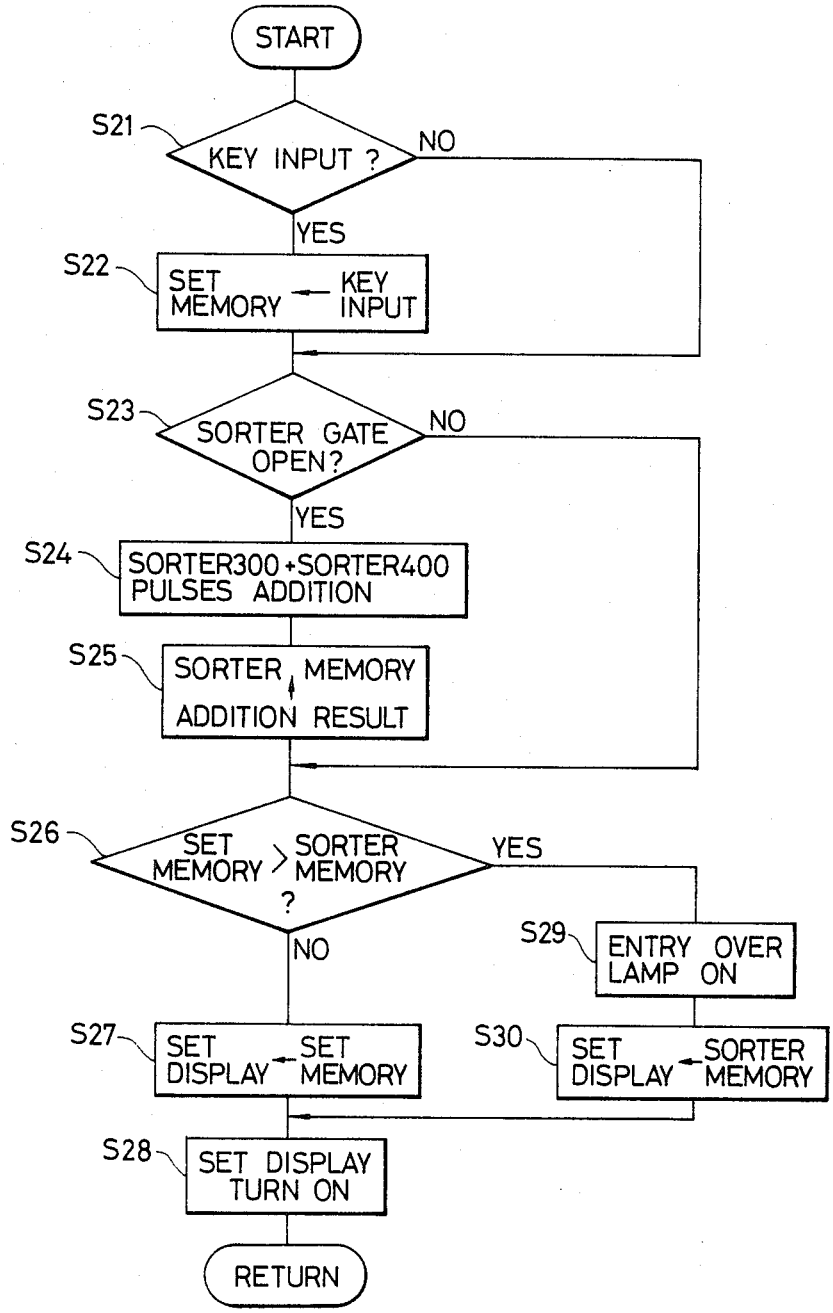

It is furthermore possible to transmit the sorting capacity of the sorter to the copier connected thereto and to light a set number overflow lamp and to display the sorting capacity on the set number indicator in order to given a warning to the operator in case the desired copy number exceeds said sorting capacity. This embodiment will be explained in the following in relation to FIG. 7, wherein the Steps S21 to S25 are identical with the Steps S1 to S5 in FIG. 5 and are therefore omitted from the explanation.

The Step S26 compares the number stored in the set number memory ME2 with that stored in the sorter memory ME1. If the former is smaller, the program proceeds to the Step S27 for supplying the number stored in the set memory ME2 to the set number indicator 505 and then to the Step S28 for displaying said number on the set number indicator 505.

On the other hand, if the former is larger in the Step S26, the program proceeds to the Step S29 for lighting the set number overflow lamp 507, then to the Step S30 for supplying the number stored in the sorter memory ME1 to the set number indicator 505 and to the Step S28 for displaying the sorting capacity on the set number indicator 505.

It is naturally possible also to display the sorting capacity of the sorters on the copy number indicator.

As explained in the foregoing, the present invention allows the operator to confirm whether the sorting capacity of the sorters exceeds the set number prior to the start of copying operation, thereby avoiding the time and labor wasted in manual sorting of the copies ejected without sorting. A similar effect is also obtainable in an attachment other than a sorter.

In the foregoing embodiments the copier may be so constructed as to enable the copying operation in case a set number exceeding the sorting capacity is entered and to eject the overflowing copy sheets to the non-sort bin, or to disable the copying operation in such case.

What we claim is:

1. An image forming apparatus with attachment comprising:

image forming means for forming an image on a recording sheet;

display means for displaying a number relating to said image formation;

an attachment device for performing a predetermined processing of the recording sheets transported after image formation by said image forming means; and control means for controlling said display means such that in case the number of recording sheets upon which an image is to be formed exceeds the processing capacity of said attachment device, said display means displays the processing capacity of said attachment device, and in case the desired number is less than the processing capacity of said attachment device, said display means displays the number relating to the image formation.

2. An image forming apparatus with attachment according to claim 1, wherein said attachment device is a sorter for distributing and storing said recording sheets.

3. An image forming apparatus with attachment according to claim 1, wherein said control means is adapted to cause intermittent lighting of said display means in case said desired number exceeds said processing capacity.

4. An image forming apparatus with attachment according to claim 1 or 3, wherein said display means is adapted to display said desired number.

5. An image forming apparatus with attachment according to claim 1, wherein said processing capacity is the number of bins of said sorter.

6. An image forming apparatus with attachment comprising image forming means for forming an image on a recording sheet;

display means for displaying a number relating to said image formation;

an attachment device for performing a predetermined processing of the recording sheets transported after image formation by said image forming means; and control means for causing, under a certain condition, said display means to indicate a processing capacity of said attachment device for a predetermined time.

7. An image forming apparatus with attachment according to claim 6, further comprising a selecting means for selecting said attachment device, and wherein said certain condition is a state where said selecting means is activated.

8. An image forming apparatus with attachment according to claim 6, wherein said display means is adapted to display the set number of recording sheets to be used in said image formation.

9. An image forming apparatus with attachment according to claim 6, wherein said control means is adapted to display the state of said attachment device for a determined period.

10. An image forming apparatus with attachment according to claim 6, 7 or 9, wherein said attachment device is a sorter for distributing and sorting said recording sheets.

11. An image forming apparatus with attachment according to claim 9, wherein said state of the attachment device is the processing capacity of said attachment device.

12. An image forming apparatus with attachment according to claim 9 wherein said attachment device is a sorter for distributing and sorting said recording sheets and wherein said state of the attachment device is the processing capacity of said sorter.

* * * * *